United States Patent [19]

Batts et al.

[11] 4,177,908

[45] Dec. 11, 1979

[54] LOCKING PARALLEL BAR HANGER

[75] Inventors: John H. Batts; Judd F. Garrison, both of Grand Rapids, Mich.

[73] Assignee: John Thomas Batts, Inc, Zeeland, Mich.

[21] Appl. No.: 890,031

[22] Filed: Mar. 27, 1978

Related U.S. Application Data

[63] Continuation-in-part of Ser. No. 773,536, Mar. 2, 1977, abandoned.

[51] Int. Cl.[2] ..... A47J 51/14

[52] U.S. Cl. ..... 223/96

[58] Field of Search ..... 223/91, 96, 93; 211/113, 96, 124, 116; 16/DIG. 1; 403/163

[56] References Cited

U.S. PATENT DOCUMENTS

| | | | |
|---|---|---|---|
| 364,346 | 6/1887 | Hauck | 223/96 |
| 835,481 | 11/1906 | Taylor | 223/96 |
| 982,120 | 1/1911 | Bell et al. | 223/91 |
| 1,008,327 | 11/1911 | Hamilton | 223/91 |
| 1,112,775 | 10/1914 | Crutcher | 223/96 X |
| 1,196,916 | 9/1916 | Welch | 223/91 |
| 2,226,786 | 12/1940 | Stirn | 223/91 |
| 3,164,054 | 1/1965 | Biesecker | 403/163 |
| 3,741,449 | 6/1973 | Mackenzie | 223/91 |

FOREIGN PATENT DOCUMENTS

| | | | |
|---|---|---|---|
| 262290 | 7/1913 | Fed. Rep. of Germany | 223/91 |
| 2300197 | 10/1976 | France | 16/DIG. 13 |

*Primary Examiner*—George H. Krizmanich

*Attorney, Agent, or Firm*—Price, Heneveld, Huizenga & Cooper

[57] ABSTRACT

A molded pants hanger includes a lower bar and an upper bar positioned above and spaced from the lower bar in the same vertical plane. Adjacent ends of the upper and lower bars are detachably and hingedly interconnected with the upper bar movable from an open position to closed position generally parallel with the lower bar. A support hook is joined to the center of the lower bar. A side latch including an L-shaped member integral with the free end of the lower bar cooperates with a recess formed in the free end of the upper bar to latch the upper bar to the lower bar.

29 Claims, 15 Drawing Figures

LOCKING PARALLEL BAR HANGER

CROSS REFERENCE TO RELATED APPLICATION

This is a continuation-in-part of copending application, Ser. No. 773,536, filed Mar. 2, 1977 now abandoned.

BACKGROUND OF THE INVENTION

This invention relates to a pants hanger and more particularly, to a unique hanger including a pair of parallel bars which lock together and suspend a pair of pants looped over one of the bars.

Various hanger constructions have been proposed for suspending a pair of pants, slacks or the like from a horizontal support bar. Generally, these hangers have employed some form of clamp arrangement for securing the pants to the hanger. For example, commonly owned U.S. Pat. No. 3,746,223 to John H. Batts, entitled MOLDED GARMENT HANGER WITH CLAMPING TROUSER BAR and issued on July 17, 1973, discloses an integrally molded garment hanger having a contoured body and a cross bar. A cantilevered clamping bar cooperates with the cross bar to create a positive clamping force on a garment positioned therebetween. The cross bar is arched toward the clamping bar so that when the latter is secured by a keeper, the positive clamping force is obtained.

U.S. Pat. No. 3,730,406 to Sullivan, entitled GARMENT-EXPOSING TROUSER HANGER and issued May 1, 1973, relates to a trouser or pants hanger for supporting a folded pair of trousers. This hanger construction includes an upper bar from but generally parallel to a lower bar. A support hook extends vertically from a position centrally of the lower bar. The pants or trousers are looped over the upper bar and the weight of the trousers tends to hold them between the upper and lower bars. In the embodiments illustrated in this patent, the upper bar is in the form of an elongated wire. Also, connection of the free ends of the upper and lower bar is accomplished by providing the lower bar with an upwardly opening socket for receipt of the free end of the wire upper bar.

Although the hanger constructions disclosed in the aforementioned patents do function to suspend a pair of trousers in a clamped fashion, a need exists for an improved trouser or pants hanger wherein the weight of the trousers assists in clamping the trousers between a pair of cooperating bars, wherein the ends of the cooperating bars are easily and readily disengageable to permit placement of the trousers on one of the cooperating bars and removal of the trousers therefrom; wherein the trousers will not be creased when suspended for long periods of time by the hanger; and wherein the hanger will suspend the trousers from a garment rod, for example, without tilting of the hanger.

SUMMARY OF THE INVENTION

In accordance with the present invention, a unique, molded hanger specifically designed for suspending a pair of slacks, pants or trousers and the like is provided. Essentially, the hanger includes an elongated, lower bar and an elongated, upper bar positionable above and in the same vertical plane as the lower bar. The upper bar is detachably hinged to an adjacent end of the lower bar. A support hook is joined to the lower bar intermediate the ends thereof and a side latching means is provided at the free end of the lower bar and the free end of the upper bar for latching the upper bar to the lower bar after a pair of slacks has been folded over the upper bar.

In narrower aspects of the invention, the upper bar includes an open recess or notch adjacent its free end and the lower bar includes a generally L-shaped member, one leg of which is insertable into the recess for latching the upper and lower bars together. The upper bar has a generally U-shape in cross section and the lower bar includes a curved flange extending longitudinally along the upper transverse edge of the bar. The curved flange and the U-shaped upper bar prevent creasing of a pair of trousers and the like when they are looped over the upper bar. Further, the support hook includes an angled stem portion dimensioned so that the hook portion extends in a vertical plane corresponding to the front plane of the hanger so that tilting of the hanger when placed on a garment rod is eliminated.

DETAILED DESCRIPTION OF THE PREFERRED EMBODIMENT

Figure 1:
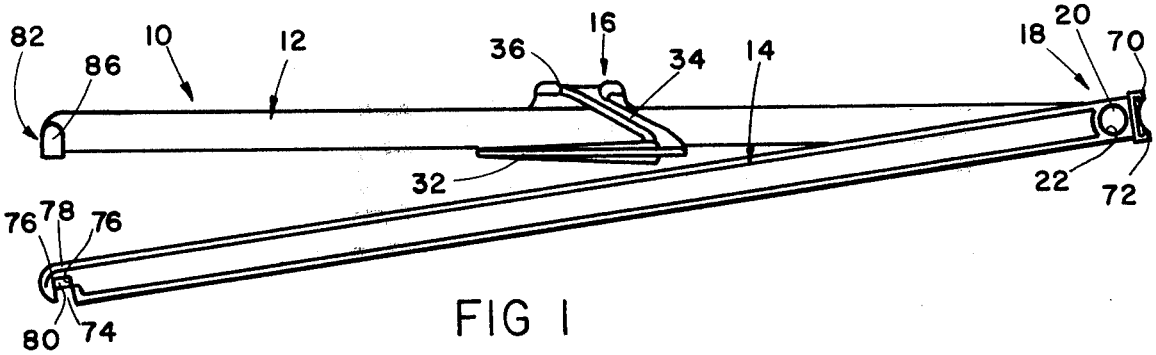
FIG. 1 is a top, plan view of the unique hanger in accordance with the present invention illustrating the hanger bars in an open position.

The unique, molded trouser, slacks or pants hanger, in accordance with the present invention, is illustrated in the drawings and generally designated 10. As best seen in FIG. 1, the hanger 10 includes a lower bar 12, an upper bar 14 and a support hook 16. The upper bar 14 is hingedly or pivotally connected to a lower bar 12 by a hinge means 18 including a pivot post 20 and a cooperating socket 22, as more fully described below.

Figure 2:
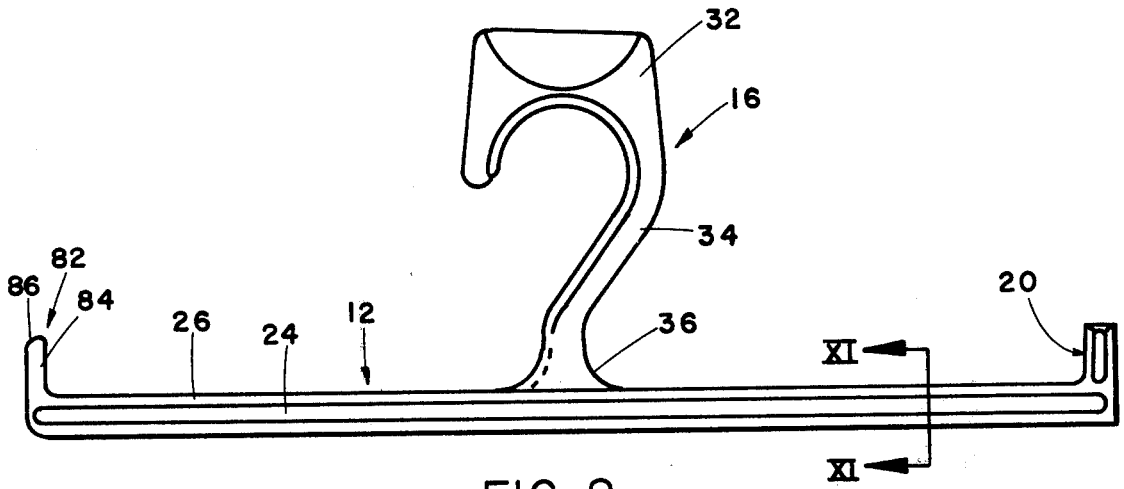
FIG. 2 is a front, elevational view of the lower bar of the unique hanger of FIG. 1.
Figure 11:
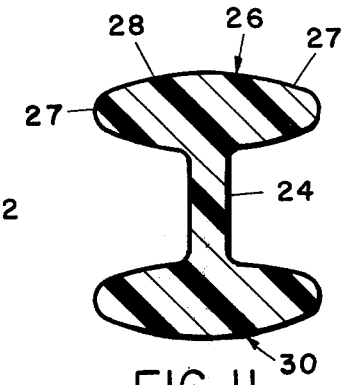
FIG. 11 is an enlarged, cross section taken along line XI—XI of FIG. 2.
Figure 10:
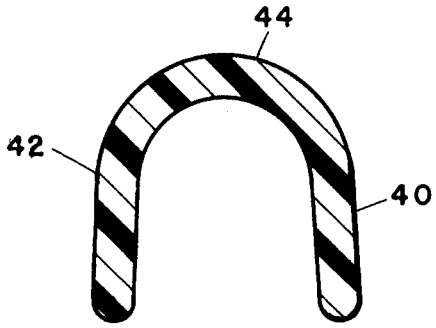
FIG. 10 is an enlarged, cross section taken along line X—X of FIG. 3.

As best seen in FIGS. 1, 2 and 11, the lower bar is preferably molded as an elongated member including a flat, vertical, longitudinally extending central portion 24. Molded integral with the upper lateral edge of the central portion 24 is a flange 26. The flange 26 includes an upper arcuate surface 28. Molded integral with the lower lateral edge of the central portion 24 is another flange 30. The pivot post 20 extends upwardly in the same plane as the lower bar 12 and is molded integral with the bar adjacent one end thereof.

The support hook 16, preferably molded integral with the lower bar, joins the lower bar intermediate the ends and approximately at the center thereof. The hook 16 includes an upper support hook portion 32 and a lower shank or stem 34. The shank or stem 34 includes a lower vertical portion 36 which joins the lower bar 12 adjacent the center of the flange 26 and adjacent the lateral edge of the flange. The portion 36 extends upwardly in a vertical plane offset laterally from the vertical plane extending through the longitudinal centerline of the lower bar 12. The central portion 34 of the stem is angled with respect to the bar and with respect to the hook portion 32. The hook portion 32 is positioned in a vertical plane spaced or offset forwardly from the vertical plane extending through the longitudinal centerline of the bar 12. The center of the hook portion 32 is at the approximate center of the lower bar 12. As best seen in FIG. 1, the hook portion 32 is immediately adjacent or lies in a plane positioned in front of the front plane of the hanger. This angling of the stem so that the hook portion is positioned in such a vertical plane prevents or substantially eliminates tilting of the hanger when it is employed to suspend a pair of trousers from a clothes rack, for example.

As best seen in FIGS. 1, 3, 4 and 10, the upper bar 14 is preferably molded as an elongated member having a generally U-shape in cross section. The upper bar 14 therefore includes a front wall 40, a rear wall 42 and a curved, top wall or base portion 44 joining the front and rear walls together.

In the preferred embodiment, the upper bar 14 is hingedly or pivotally connected to the lower bar 12 through the hinge means 18. The upper bar 14 is movable to a first position superimposed above the lower bar and in the same vertical plane as the lower bar. The pivot or hinge means 18 also permits movement of the upper bar 14 relative to the lower bar to a second, open position wherein the upper bar lies in a plane positioned at an angle and intersecting the vertical plane of the lower bar.

Figure 3:
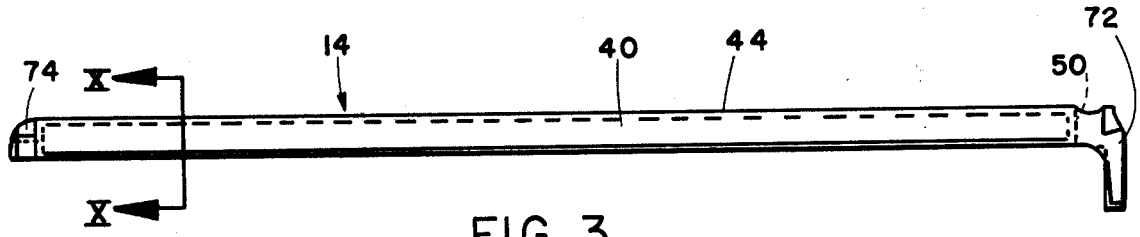
FIG. 3 is a front, elevational view of the upper bar of the hanger of FIG. 1.
Figure 4:
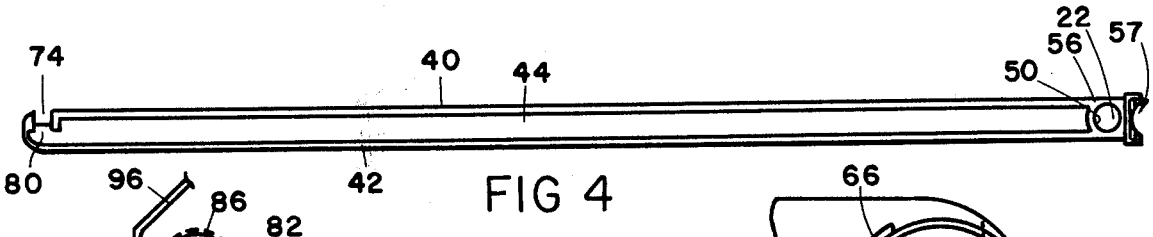
FIG. 4 is a bottom, plan view of the upper bar of FIG. 3.
Figure 5:
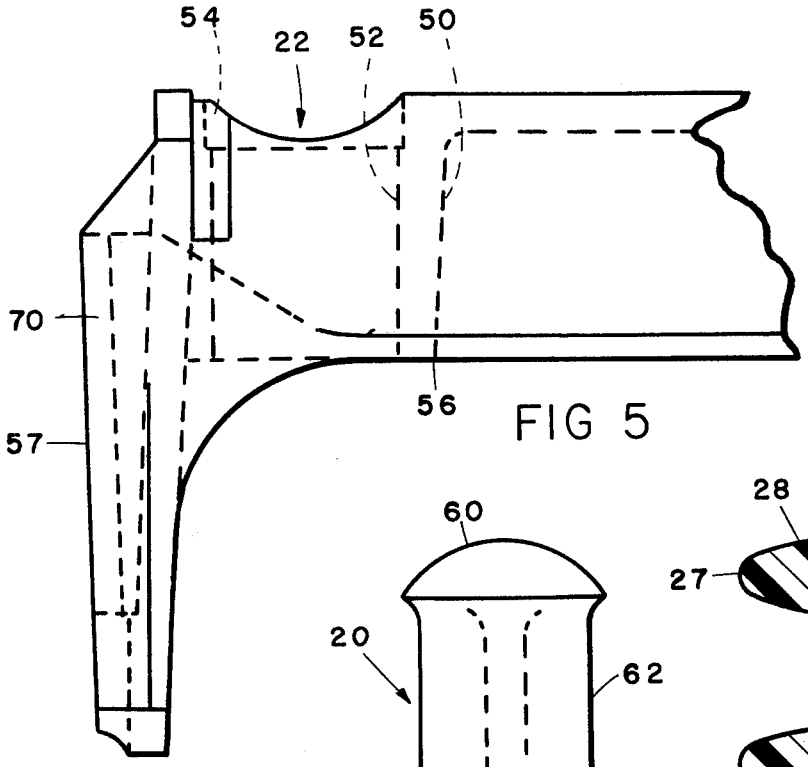
FIG. 5 is an enlarged, fragmentary, rear elevation of the top bar of the hanger illustrating the socket portion of the hinge means.

As best seen in FIGS. 3, 4 and 5, the upper bar socket 22 is defined by a through bore or cylindrical shaped portion 50, preferably molded integral with the end of the upper bar. The socket 22 includes a first portion 52 extending from the undersurface of the upper bar to a point adjacent the upper surface 44 of the bar 14. A second portion 54 is formed coaxially with the first portion 52 and has a diameter slightly greater than the diameter of the first portion 52. The lower end of the cylindrical portion 50 terminates in a bearing surface 56. Also, the end of the upper bar 14 is formed with an integral, depending flange or end wall 57. The end wall 57 joins the front and rear walls 40, 42 of the upper bar and extends in a plane perpendicular to the vertical plane of the upper bar.

Figure 8:
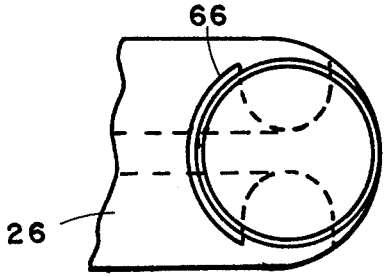
FIG. 8 is an enlarged, fragmentary, top plan view of the lower bar illustrating the pivot post.
Figure 7:
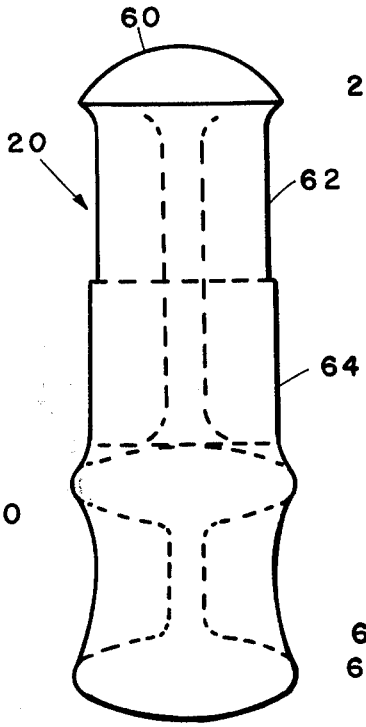
FIG. 7 is an enlarged, side elevational view of the lower bar.
Figure 6:
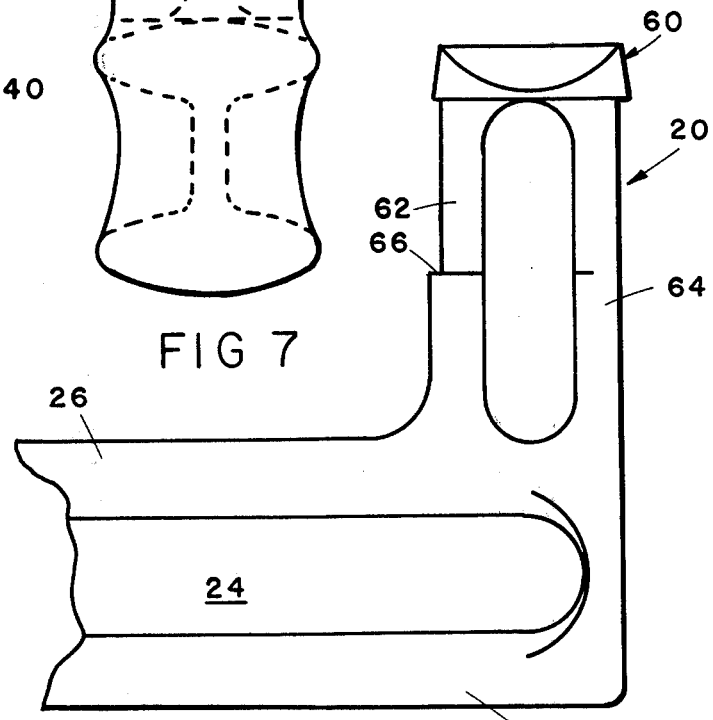
FIG. 6 is an enlarged fragmentary, front elevational view of the lower bar illustrating the pivot post of the hinge means.

As best seen in FIGS. 6, 7 and 8, the pivot post 20 is molded integral with one end of the lower bar 12. The post 20 has a generally cylindrical shape and includes an upper detent flange 60, a main cylindrical portion 62 and a lower cylindrical portion 64. The upper surface of the lower portion 64 defines a bearing shoulder 66. As seen in FIGS. 6 and 7, therefore, the pivot post 20 has a generally stepped configuration.

The detent flange 60 has a diameter slightly greater than the diameter of the first cylindrical portion 52 of the socket and substantially equal to or slightly less than the diameter of the enlarged cylindrical portion 54 of the socket. The diameter of the main cylindrical portion 62 of the pivot pin is substantially equal to or slightly less than the diameter of the main cylindrical portion of the socket. Finally, the bearing shoulder or flange 66 is dimensioned so that it will engage the bearing surface 56 of the cylindrical portion 50 which defines the socket 22. As best seen in FIGS. 6 and 8, the bearing shoulder 66 need not extend around the entire periphery of the pivot post 20. It is preferred that the shoulder 66 be dimensioned merely to provide an adequate bearing surface upon which the lower end of the cylindrical portion 50 rides for smooth operation. The post 20 has a lengthwise dimension so that the bearing flange 66 also serves as a stop, properly positioning the upper bar 14 in a spaced, parallel relationship with the lower bar 12.

In assembling the upper bar 14 to the lower bar 12, the pivot post 20 is inserted into the socket 22. The detent flange 60 will snap into the enlarged cylindrical bore portion 54 of the socket and the lower surface 56 of the cylinder 50 will engage the bearing shoulder 66. In this manner, the upper bar is positively, yet detachably, hinged or pivotally connected to a lower bar for movement from the first, closed position to the second, open position. In the open position, slacks, trousers or the like may be folded over the upper bar as fully described below.

The end wall 57 of the upper bar preferably includes a pair of spaced, vertically extending guides or tracks 70, 72. These guides or tracks are adapted to receive a rectangular shaped tally for the display of price or size information. The end wall 57 also, as best seen in FIG. 1, serves as a pivot stop to limit the pivoting of the upper bar 14 relative to a lower bar 12. As should be apparent, when the upper bar 14 is pivoted outwardly to an angle slightly greater than 90° with respect to the lower bar, the end wall 57 will engage the rear surface of the lower bar and prevent further outward pivotal movement.

Figure 12:
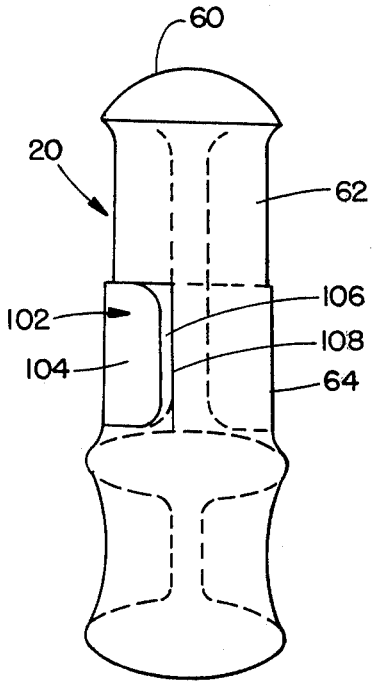
FIG. 12 is an enlarged, side elevational view of the lower bar showing a stop means for the upper bar.
Figure 13:
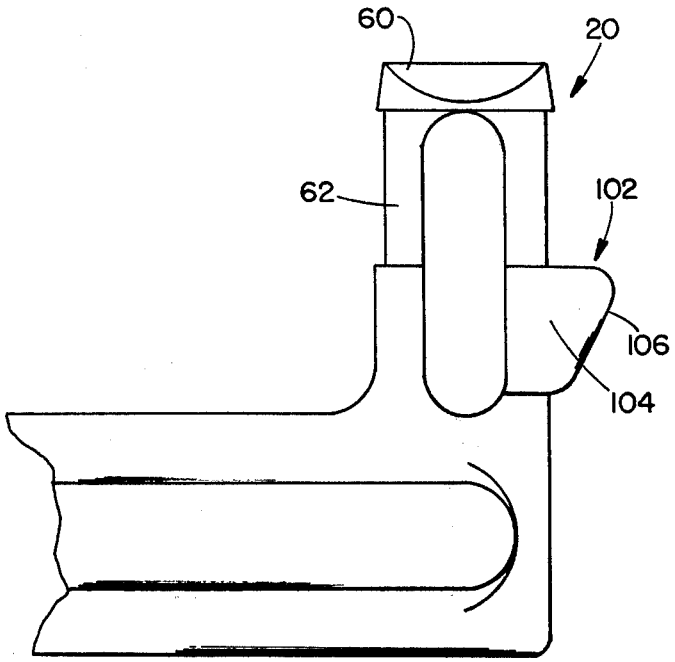
FIG. 13 is an enlarged, fragmentary, front elevational view of the lower bar illustrating the pivot post and stop means of the hinge means.
Figure 15:
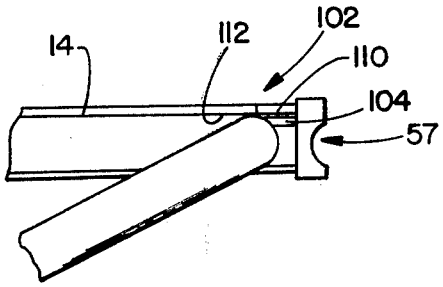
FIG. 15 is a fragmentary, bottom plan view showing the upper bar pivoted to its second position relative to the lower bar at which it engages the stop means.
Figure 14:
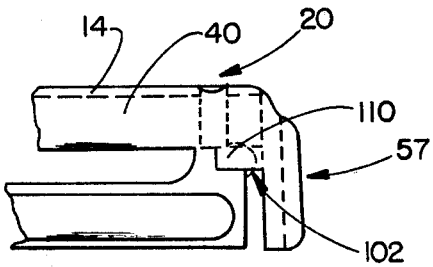
FIG. 14 is a fragmentary, front elevational view showing the upper bar attached to the lower bar.

As seen in FIGS. 12–15, it is presently preferred that a pivot or limit stop in addition to that provided by the end wall 57 be included in the hanger to limit the outward pivotal movement of the upper bar 14 relative to the lower bar 12 from the first to the second position. As seen in FIGS. 12 and 13, a pivot or limit stop tab or stop means 102 is preferably formed integral with the lower cylindrical portion 64 of the pivot post 20. The stop tab 102 extends outwardly relative to the post 20 and includes a front surface 104, a free end 106 and a rear surface 108. The front surface 104 is preferably angled relative to the vertical plane of the lower bar 16 and extends tangentially relative to the pivot post. The stop tab 102 is positioned on the front of the lower bar 16. As best seen in FIGS. 14 and 15, when the upper bar is attached to the lower bar at the pivot post 20, the inner surface of the front wall 40 of the upper bar overlies the stop tab 102. The upper bar may be pivoted outwardly from the lower bar to a second position at which the inner surface 112 of a portion of the depending front wall 40 of the upper bar 14 engages the angled surface 104 of the stop tab. The stop tab 102 is dimensioned to provide a stop for the upper bar relative to the lower bar. It is presently preferred that the surface 104 of stop 102 be angled approximately 45° relative to a vertical plane through the lower bar to thereby limit outward opening or pivoting movement of the upper bar to an approximate 45° angle. The stop tab can be dimensioned to permit the upper bar to be overridden relative to the lower bar so that it may be pivoted outwardly to an angle greater than 90° at which the end wall 57 would abut the lower bar as discussed above. The upper bar is preferably fabricated from a plastic material which has an inherent resilience. The front wall 40 of the upper bar may be deformed over the stop tab 102 to provide such overriding action. The stop means 102 on the pivot post 20 insures ease of handling of the hanger by the user.

To prevent overriding, the stop tab may extend further up the post to contact a larger area of the inner surface 112 of the upper bar. However, if a more positive stop is desired, it is presently preferred that front wall 40 be extended downwardly at the socket area 22 to define a depending portion 110, as shown in FIG. 14. The depending portion 110 increases the contact area against which the stop acts, thereby increasing the effectiveness of the stop. By limiting the outward pivotal movement of the upper bar, pants, slacks and the like may be more easily positioned on the upper bar. If the upper bar is permitted to swing out past an angle of 90°, the ease of use of the hanger may be reduced.

Figure 9:
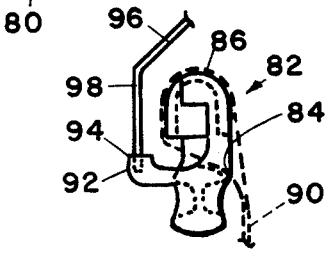
FIG. 9 is a fragmentary, end elevation of the hanger showing the bars in the locked or closed position.

Formed as part of the free ends of the upper and lower bars is a latching means for effectively holding the upper bar in the closed position after a pair of pants have been draped or folded thereover. In the preferred form, the front wall 40 and the top wall 44 of the upper bar 14 are relieved so as to define a recess 74. The recess includes sidewalls 76, a rear wall 78 and a bottom wall 80. The bottom wall 80 is defined by a block-like member molded integral with the free end of the upper bar 14. As best seen in FIGS. 1, 2 and 9, the free end of the lower bar 12 is provided with an integral L-shaped latch member 82. The latch member 82 includes a first leg 84 which extends vertically from and perpendicular to the lower bar 12 from a point adjacent the lateral edge thereof. A second leg 86 extends perpendicular to the first leg 84 towards the rear of the hanger. The second leg 86 is dimensioned to be insertable within the recess 74 of the upper bar 12.

In use, the upper bar 14 is attached to the lower bar 12 and is pivoted to an open position angled with respect to the lower bar at which the front surface 104 of stop 102 engages the inner surface of front wall 40 or depending portion 110. As seen in FIG. 9, a pair of slacks or the like 90 may then be folded over the upper bar 14. The upper bar 14 will then be pivoted towards the lower bar 12. The upper bar 14 is sufficiently resilient so that the free end thereof may be lifted over the latch 82 and the second leg 86 may be inserted along its horizontal axis into the recess 74. The weight of the trousers suspended from the upper bar will bias the upper bar so that the free end thereof will be held in engagement with the latch 82.

The upper surface or top wall 44 of the upper bar 14 and the lateral edges 27 and top of the flange 26 of the lower bar 12 are curved. As a result, a pair of pants suspended from the hanger, will not be creased when held between the bars 12, 14. The curved upper surface 44 and the flange 26 besides preventing creasing also increases the surface contact area of the hanger bars with the trousers. This contact area increases the resistance to movement between the bars and the trousers. This frictional resistance assists in preventing slippage or shifting of the trousers on the hanger. It is preferred that the spacing between the upper and lower bars when they are in their closed or latched position be such that the pants will be lightly clamped between the upper and lower bars.

When the hanger is used and the pants or trousers 90 are folded over the upper bar 14, and the bars are moved to the closed position, the bars are spaced in the same vertical plane, positioned generally parallel relative to each other and are locked against vertical displacement and horizontal movement relative to each other. The weight of the pants tends to increase or assist in providing the clamping action that the two bars exert on the pants. Further, the weight of the trousers or pants also increases the latching or locking force at the recess 74 and the leg 86. This prevents disengagement of the upper bar 14 from the lower bar 12 during normal use. Further, since the support hook includes an angled portion 34 so that the hook portion 32 extends in a plane generally flush with the vertical plane of the front face of the hanger, the hanger should not assume a tilted position when it is placed on a garment rod.

As shown in FIG. 9, the support hook 16 need not be formed as an integral part of the lower bar 12. A boss 92 may be molded integral with the lateral edge of the upper flange 26 so as to extend outwardly and in a plane spaced from the vertical plane of the bar. The boss 92 includes a blind bore 94. The alternative support hook takes the form of a wire hook including a stem 96 and a lower portion 98 angled with respect to the stem 96 and disposed within the blind bore 94. When the support hook is integral with the lower bar 12, the lower bar may be molded in a simple, two-piece mold without the use of cams and the like. Similarly, the upper bar 14 is readily molded through the use of a simple, two-piece mold.

The unique garment hanger in accordance with the present invention is relatively easily manufactured through conventional molding techniques. Creasing of the trousers and slippage once the trousers are folded on the upper bar are essentially eliminated. The hanger is relatively lightweight and sufficiently strong to withstand the normal forces imposed upon it during use. Since the upper and lower bars are detachably interconnected, the hanger may be broken down for easy shipping.

In view of the foregoing description, it should now be readily apparent that the unique, molded pants hanger in accordance with the present invention provides significant advantages over the hangers heretofore provided for the suspension of slacks or trousers. The side latch arrangement, the support hook, and the hinge result in an easily usable hanger. The upper bar may be pivoted to a position well spaced from the lower bar. The slacks may then be easily folded over the upper bar. The support hook prevents tilting and the side latching arrangement positively and effectively maintains the hanger in the closed position during normal use.

Various modifications may now become apparent to those of ordinary skill in the art that would not depart from the inventive concepts disclosed herein. Therefore, it is expressly intended that the above description should be considered as that of the preferred embodiment only. The true spirit and scope of the present invention will be determined by reference to the appended claims.

The embodiments of the invention in which an exclusive property or privilege is claimed are defined as follows.

1. A hanger for suspending slacks, pants and the like comprising:
   an elongated, lower bar;
   an elongated, upper bar positioned above and spaced from said lower bar;
   hinge means for detachably and hingedly joining said upper bar to said lower bar adjacent one of the ends of each of said bars, said hinge means permitting pivotal movement of said upper bar from a first, closed position above and parallel with said lower bar to a second, open position in a vertical plane angled with respect to the vertical plane of said lower bar and permitting said bars to be detached from each other;
   support means joined to said lower bar intermediate the ends thereof for hanging said hanger; and
   latching means a part of said lower bar and said upper bar for latching said upper bar to said lower bar when in the first, closed position.

2. A hanger as defined by claim 1 wherein said hinge means comprises:
   a pivot post formed integral with said lower bar adjacent one end thereof; and
   socket means defined by said upper bar for receiving said pivot post in a detent type fashion.

3. A hanger as defined by claim 2 further including stop means on one of said bars for limiting the pivotal movement of said upper bar relative to said lower bar.

4. A hanger as defined by claim 3 wherein said stop means comprises a limit tab having a surface extending tangentially from said pivot post, said limit tab surface dimensioned to be engaged by said upper bar after limited pivotal movement relative to said lower bar.

5. A hanger for suspending slacks, pants and the like comprising:
   an elongated, lower bar;
   an elongated, upper bar positioned above and spaced from said lower bar;
   hinge means for detachably and hingedly joining said upper bar to said lower bar adjacent one of the ends of each of said bars, said hinge means permitting pivotal movement of said upper bar from a first, closed position above and parallel with said lower bar to a second, open position in a vertical plane angled with respect to the vertical plane of said lower bar;
   support means joined to said lower bar intermediate the ends thereof for hanging said hanger; and
   latching means a part of said lower bar and said upper bar for latching said upper bar to said lower bar when in the first, closed position, said hinge means comprising a pivot post formed integral with said lower bar adjacent one end thereof; and socket means defined by said upper bar for receiving said pivot post in a detent type fashion, said socket means including said upper bar having a cylindrical bore extending vertically through said upper bar, said bore having a stepped configuration in cross section including a first portion of one diameter and second portion of another diameter greater than the diameter of said first portion.

6. A hanger as defined by claim 5 wherein said pivot post extends perpendicular to said lower bar and has a generally cylindrical shape.

7. A hanger as defined by claim 6 wherein said pivot post further includes an upper detent flange dimensioned to snap fit within said second portion of said socket means cylindrical bore.

8. A hanger as defined by claim 7 wherein said pivot post further includes a bearing shoulder adjacent the juncture of said pivot post to said lower bar, said upper bar at said cylindrical bore resting on said bearing shoulder.

9. A hanger as defined by claim 2 wherein said latching means comprises said upper bar defining a recess adjacent the free end thereof and said lower bar further including a generally L-shaped member having the end of one leg integral with the free end of said lower bar, the remaining leg extending into said recess when said upper bar is in the first, closed position.

10. A hanger as defined by claim 9 wherein said one leg of said L-shaped member joins said lower bar adjacent the lateral edge thereof.

11. A hanger as defined by claim 10 wherein said upper bar has a generally U-shape in cross section including first and rear vertical walls joined by a curved top wall.

12. A hanger as defined by claim 11 wherein said elongated lower bar has a width greater than its thickness and includes a curved, upper slacks engaging flange extending along the upper lateral edge thereof whereby a pair of slacks may be folded over the curved top wall of said upper bar and will be engaged by the curved upper slacks engaging flange when said upper bar is in the first, closed position.

13. A hanger as defined by claim 12 wherein said support means comprises:
   a support hook having a top hook portion and a stem portion, said stem portion joining said lower bar adjacent the center thereof and being angled with respect to said top hook portion and the vertical plane of said lower bar, said top hook portion lying in a vertical plane offset from the longitudinal centerline of said lower bar so that tilting of said hanger when suspending slacks is prevented.

14. A hanger as defined by claim 13 further including a boss integral with said lower bar adjacent the lateral edge thereof and extending upwardly in a plane parallel to and spaced from the vertical plane of said lower bar, said boss having a blind bore and wherein said support hook is a wire hook and the end of said stem portion is disposed within said blind bore.

15. A hanger as defined by claim 14 wherein said socket means includes said upper bar having a cylindrical bore extending vertically through said upper bar, said bore having a stepped configuration in cross section including a first portion of one diameter and second portion of another diameter greater than the diameter of said first portion.

16. A hanger as defined by claim 15 wherein said pivot post further includes an upper detent flange dimensioned to snap fit within said second portion of said socket means cylindrical bore.

17. A hanger as defined by claim 16 wherein said pivot post further includes a bearing shoulder adjacent the juncture of said pivot post to said lower bar, said upper bar at said cylindrical bore resting on said bearing shoulder.

18. A molded plastic hanger for suspending slacks and the like comprising:

an elongated, first bar extending longitudinally in a vertical plane;

an elongated, second bar superimposed with respect to said first bar and extending longitudinally in the same vertical plane when in a first position, the lower lateral edge of said second bar spaced from the upper lateral edge of said first bar, one of said bars having a through bore adjacent one end thereof;

a pivot post molded integral with one end of the other of said bars, said pivot post received within said through bore in a snap fit fashion so that said bars are detachably and hingedly joined together, said bars being pivotable relative to each other from said first position to a second position wherein one of said bars is angled with respect to the other of said bars;

a support hook connected to the center of one of said bars adjacent the lateral edge thereof; and side latching means a part of said second bar and said first bar for latching the free end of said second bar to the free end of said first bar when said bars are in the first position.

19. A molded plastic hanger as defined by claim 18 wherein said support hook is molded integral with said first bar and includes a stem portion and a hook portion.

20. A molded plastic hanger as defined by claim 19 wherein said stem portion is angled relative to said first bar and said hook portion so that said hook portion lies in a vertical plane offset from the vertical plane of said bars and adjacent the front surfaces thereof.

21. A molded plastic hanger for suspending slacks and the like comprising:

an elongated, first bar extending longitudinally in a vertical plane;

an elongated, second bar superimposed with respect to said first bar and extending longitudinally in the same vertical plane when in a first position, the lower lateral edge of said second bar spaced from the upper lateral edge of said first bar, one of said bars having a through bore adjacent one end thereof;

a pivot post molded integral with one end of the other of said bars, said pivot post received within said through bore, said bars being pivotable relative to each other from said first position to a second position wherein one of said bars is angled with respect to the other of said bars;

a support hook connected to the center of one of said bars adjacent the lateral edge thereof; and side latching means a part of said second bar and said first bar for latching the free end of said second bar to the free end of said first bar when said bars are in the first position, said support hook being molded integral with said first bar and including a stem portion and a hook portion, said stem portion being angled relative to said first bar and said hook portion so that said hook portion lies in a vertical plane offset from the vertical plane of said bars and adjacent the front surfaces thereof, said side latching means including said second bar having a recess therein adjacent the free end thereof and intermediate the lateral edges thereof and a generally L-shaped member molded integral with said first bar adjacent the free end thereof, said L-shaped member extending vertically in a plane perpendicular to the plane of said first bar and dimensioned so that the free leg of said member is positioned within said recess when said bars are moved to said first position.

22. A molded plastic hanger as defined by claim 21 wherein said second bar includes a longitudinally extending slacks engaging flange along the upper lateral edge thereof, said flange having a curved upper surface whereby creasing of said slacks when looped over said first bar and said bars are moved to said first position is prevented.

23. A molded plastic hanger as defined by claim 21 wherein the lateral edges of said slacks engaging flange are rounded and wherein the lower lateral edge of said second bar includes a reinforcing flange extending longitudinally thereof.

24. A molded plastic hanger as defined by claim 18 wherein said side latching means includes said second bar having a recess therein adjacent the free end thereof and intermediate the lateral edges thereof and a generally L-shaped member molded integral with said first bar adjacent the free end thereof, said L-shaped member extending vertically in a plane perpendicular to the plane of said first bar and dimensioned so that the free leg of said member is positioned within said recess when said bars are moved to said first position.

25. A hanger for suspending slacks, pants and the like comprising:

an elongated, lower bar;

an elongated upper bar positioned above and spaced from said lower bar;

hinge means for detachably and hingedly joining said upper bar to said lower bar adjacent one of the ends of each of said bars, said hinge means permitting pivotal movement of said upper bar from a first, closed position above and parallel with said lower bar to a second, open position in a vertical plane angled with respect to the vertical plane of said lower bar and permitting said bars to be detached from each other; stop means on one of said bars for limiting the pivotal movement of said upper bar relative to said lower bar so that said upper bar when in said second position assumes an angle less than 90° with respect to said vertical plane of said lower bar; and support means joined to said lower bar intermediate the ends thereof for hanging said hanger.

26. A hanger as defined by claim 25 wherein said stop means comprises a limit tab having an angled surface abutted by said upper bar after limited pivotal movement.

27. A hanger as defined by claim 26 further including latching means a part of said lower bar and said upper bar for latching said upper bar to said lower bar when in the first, closed position and wherein said hinge means comprises:

a pivot post formed integral with the lower bar adjacent one end thereof, said limit tab angled surface extending tangentially from said pivot post; and socket means defined by said upper bar for receiving said pivot post in a detent type fashion.

28. A hanger as defined by claim 27 wherein said upper bar includes a depending portion, a surface of which abuts said limit tab angled surface thereby limiting pivotal movement of said upper bar relative to said lower bar.

29. A hanger for suspending slacks, pants and the like comprising:

an elongated, lower bar;

an elongated, upper bar positioned above and spaced from said lower bar;

hinge means for hingedly joining said upper bar to said lower bar adjacent one of the ends of each of said bars, said hinge means permitting pivotal movement of said upper bar from a first, closed position above and parallel with said lower bar to a second, open position in a vertical plane angled with respect to the vertical plane of said lower bar;

stop means on one of said bars for limiting the pivotal movement of said upper bar relative to said lower bar so that said upper bar when in said second position assumes an angle with respect to said vertical plane of said lower bar of less than 90°;

support means joined to said lower bar intermediate the ends thereof for hanging said hanger, said stop means comprising a limit tab having an angled surface abutted by said upper bar after limited pivotal movement; and latching means a part of said lower bar and said upper bar for latching said upper bar to said lower bar when in the first, closed position and wherein said hinge means comprises:

a pivot post formed integral with the lower bar adjacent one end thereof, said limit tab angled surface extending tangentially from said pivot post; and socket means defined by said upper bar for receiving said pivot post in a detent type fashion, said upper bar being generally U-shaped in section and including a front wall portion having an inner surface which contacts said limit tab, said front wall being formed from a resilient material, said tab being dimensioned to permit said front wall portion to be deformed over said tab whereby said stop means may be overridden and said upper bar may be pivoted beyond said second position.

* * * * *